United States Patent [19]

McDermott

[11] Patent Number: 4,517,628

[45] Date of Patent: May 14, 1985

[54] PORTABLE LIGHTING DEVICE

[76] Inventor: Kevin McDermott, 196 Phillips Dr., Hampstead, Md. 21074

[21] Appl. No.: 547,391

[22] Filed: Oct. 31, 1983

[51] Int. Cl.[3] ..... F21L 7/00

[52] U.S. Cl. ..... 362/186; 200/60; 362/187; 362/202; 362/205; 362/206; 362/293; 362/295; 362/319; 362/321

[58] Field of Search ..... 200/60; 362/186, 187, 362/202, 205, 206, 293, 295, 319, 321

[56] References Cited

U.S. PATENT DOCUMENTS

| | | | |
|---|---|---|---|
| 2,389,591 | 11/1945 | Brown | 240/10.6 |
| 2,818,499 | 12/1957 | Moore | 240/10.68 |
| 4,195,329 | 3/1980 | Woog | 362/206 X |
| 4,292,664 | 9/1981 | Mack | 362/205 X |
| 4,346,329 | 8/1982 | Schmidt | 362/191 X |

*Primary Examiner*—Stephen J. Lechert, Jr.

*Attorney, Agent, or Firm*—Eugene F. Osborne, Sr.

[57] ABSTRACT

This invention, in the preferred embodiment, relates to battery powered hand held lamps, commonly known as flashlights, or when in compact form as pen or pocket lights. More specifically, the invention relates to quasi-blackout applications and uses that require fast visual recovery in darkness and minimum personal exposure of the operator of the device.

24 Claims, 13 Drawing Figures

PORTABLE LIGHTING DEVICE

BACKGROUND OF THE INVENTION

For example, the use of high intensity white light reflected from white papers, such as maps or writing pads, adversely affects the eyes and could influence vehicular or other accidents, if the viewer was subsequently required to make a fast judgment in another field of view where the illumination levels were then low. This invention assists in avoidance of of such hazards by confining the light beam and by making it convenient to quickly select a white light or a colored light, such as red, from the hand held lamp.

As illustrated and described herein, the invention is applied to a cylindrical flashlight of the penlight type. Broader applications of the principles and features disclosed include uses in varied lighting apparatus where a convenient and rapid change in color of the illumination is required. Features and techniques disclosed reduce the costs of manufacture and assembly and improve operating reliability.

DESCRIPTION OF PRIOR ART

Portable lighting devices such as flashlights and compact hand lamps of the cylindrical penlight variety are well known in the art. Typical of the art for such devices is a U.S. Pat. No. 2,389,591 (Brown) which disclosed one means for switching the color of the illumination. U.S. Pat. No. 2,818,499 (Moore) discloses a penlight having a tubular casing with a bulb holder, assembled in one end of the tube, a switching mechanism in the opposite end of the tube, and means for holding the dry cell batteries in fixed positions.

SUMMARY OF THE INVENTION

The present invention comprises an electrically conductive tubular casing for housing one or more dry battery power cells with improvements in a lamp and color filter mechanism for closing one end of the tube and in a plug assembly for closing the opposing end. The plug assembly provides an on-axis tie point for a carrying lanyard. The detachable plug assembly captivates and contains a heavy duty pocket clip in fixed relationship to the tubular casing. The plug assembly contains circumferentially located parts that in conjunction with the conductive casing provide means for on-off switching of the illumination. Mechanical forces of the assembled penlight are directed in a manner that assures low contact resistances for improved reliability of the lamp electrical circuit.

An object of the present invention is to provide a compact flashlight or penlight having one or more color filters for its light beam with shielding against off-axis illumination. The color of the emitted light beam is to be selectable by a rotary motion about the longitudinal axis of the penlight.

Another objective of the present invention is to provide a side operable switch for an on-off control of the illumination.

Another objective of the invention is to provide in an electrical circuit for the lamp filament a minimum number of contact points, thereby reducing the aggregate circuit resistance and yielding improvements in reliability, intensity of illumination, and battery life.

Another objective of the invention is to provide a lanyard for securing the penlight to the user or to a convenient known tie point.

Another objective of the invention is to provide the assembly of a heavy guage pocket clip to the penlight casing without the use of rivets or other permanent fasteners.

A further objective of the invention is to simplify the manufacturing and assembly processes, reduce costs, and yet enhance durability and reliability of the penlight.

BRIEF DESCRIPTION OF THE DRAWINGS

Other objects and advantages may be observed from the description when viewed in conjunction with the accompanying drawings wherein.

DETAILED DESCRIPTION OF THE INVENTION

Figure 1:
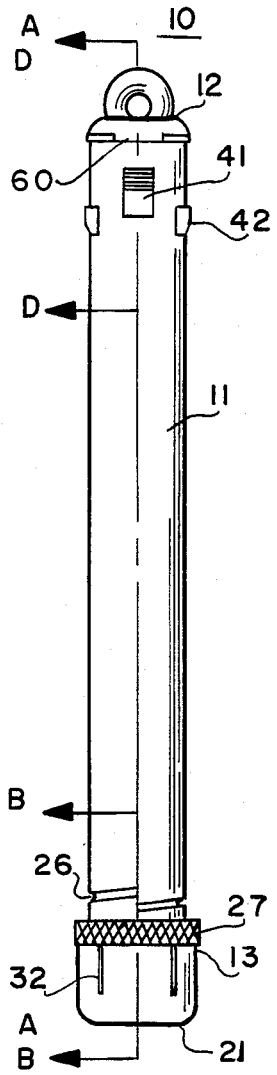
FIG. 1 is an elevation view of the penlight showing the sector containing an on-off switch.
Figure 2:
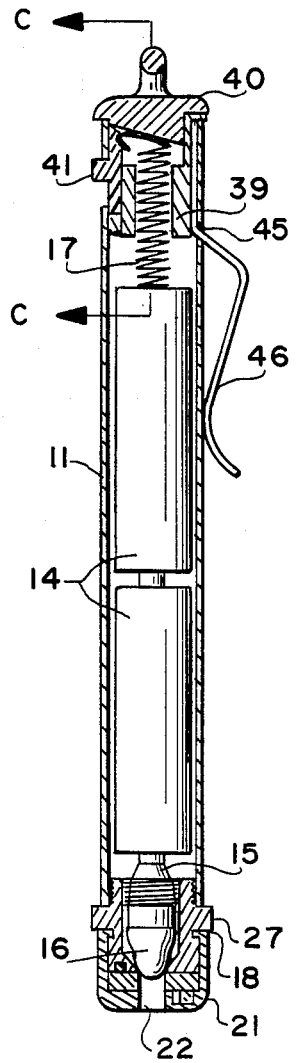
FIG. 2 is a sectional view through the penlight taken along A—A of FIG. 1.

Referring now to the drawings, the preferred embodiment of the invention is illustrated in FIGS. 1 and 2. A penlight 10 comprises an elongated cylindrical tube 11 of an electrically conductive material, typically of a metal such as aluminum or copper, having a plug assembly 12 fitted within the first or back end thereof, and a lamp and color filter mechanism 13 assembled within the second or opposite end of the cylindrical tube 11. Two dry cell batteries 14 fit end-to-end, in electrical series, within the tube 11 making positive contact with the central terminal 15 of the lamp 16, and negative contact with a contact spring 17 which is a component part of the back end plug assembly 12. A tie ring 57 is provided for an optional lanyard cord.

Figure 3:
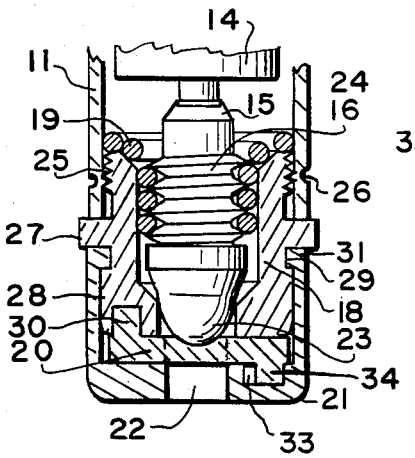
FIG. 3 is a sectional view through the lamp and color filter taken along line B—B of FIG. 1.

The lamp and filter mechanism 13, shown in detail in FIG. 3, further comprises a miniature incandescent lamp bulb 16, a bulb holder 18 for securing the mechanism 13 to the cylindrical tube 11, a volute spring 19 for establishing reliable contact between the lamp 16, bulb holder 18, and tube 11, an optical or light transmission filter 20 for color control of the light by the operator, and a covering opaque cap 21 which has a small circular aperture 22 therein through which the light rays are emitted. The miniature lamp bulb 16 is of a projection type and has a glass envelope 23 and a screw base for the return electrical terminal 24. In combination, the lamp 16, the holder 18, the filter 20 and the opaque cap 21 provide collimation of the light beam in two or more colors. The collimated light beam is emitted coincident with the longitudinal axis of the assembled penlight 10.

The holder 18 is formed so as to provide a light transmission path and an interior cavity 37 for containing the lamp bulb 16. One end of the bulb holder 18 has on its outer surface a male threaded section 25 that engages a raised thread 26 that projects from the inner surface of the cylindrical tube 11. The raised thread 26 of the cylindrical tube 11 can be a sequence of embossed sectors produced by a hydraulic stamping operation.

Returning to the bulb holder 18, its central flange 27 has a diameter slightly larger than the diameter of the cylindrical tube 11, thereby providing a stop for the assembly of the parts. Flange 27 is knurled to provide a finger gripping surface for assembly. At the end of the holder opposite the threaded section 25 a second but smooth flange 28 is raised, having a diameter smaller than the diameter of the knurled flange 27, to provide a means for mounting and retaining the opaque cap 21. A circular receptacle 29 is provided in the annular flat end surface of the holder 18 at a point near the circumference of the flange 28 into which a pivot axle 30 of the color transmission filter 20 is fitted.

The opaque cover or cap 21 is made in a cup-like form using plastics well known in the arts to have elastic and resilient properties. The brim of the cup-like cap 21 is extended radially inward to form a lip 31. On assembly the lip 31 abuts the knurled flange 27 and encloses the smooth flange 28 of the bulb holder 18. In order to assemble the cap 21 over the flange 28, a multiplicity of slots 32, typically four in number are circumferentially equally spaced and extend for approximately half the distance from the brim toward the base of the cap 21. Each sector of the cap wall will spring outward for assembly over the flange 28 of the bulb holder 18. In the interior side of the end wall of the cup-like cap 21, an oval receptacle 33 accepts a traveling shaft or pin 34 of the color filter 20.

Figure 4:
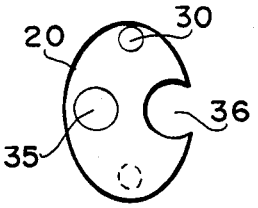
FIG. 4 is a plan view of a preferred optical color filter.
Figure 5:
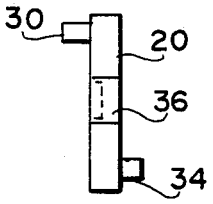
FIG. 5 is an edge view of the filter shown in FIG. 4.

Filter 20 is of plastics having optical properties. The filter 20 has two parallel sides shaped substantially elliptical, FIG. 4. Shown in the edge view of FIG. 5 are the locations, on opposite sides of the filter 20, of the pivot axle 30 and the traveling pin 34. The axle 30 and pin 34 are at opposite ends of the principle axis of the elliptical forms. On the minor axis, shown in FIG. 4, an indexing depression 35 and an indexing aperture 36 are located. The filter 20 is placed between the bulb holder 18 and the opaque cap 21 so that the pivot axle 30 fits in the holder receptacle 29 and the traveling pin 34 fits in oval receptacle 33 of the cap 21. When the cap is rotated relative to the tubular body 11 the filter 20 will swing in or out of the light beam then being emitted by the lamp bulb so that the color of the light may be manually selected.

The dimensions of the bulb holder are designed so that the lamp 16, when seated in place, will extend its projection lens 23 slightly beyond the holder surface. The lamp bulb 23 projects into either an indexing depression 35 or the aperture 36 of the filter. Being spring supported, the lamp bulb 16 will move backward on its axis as the filter 20 swings from color to color, i.e., from the depression 35 to the aperture 36. When seated in the depression 35 or the aperture 36, the lamp locks the cap 21 and the filter 20 in the position selected.

Figure 6:
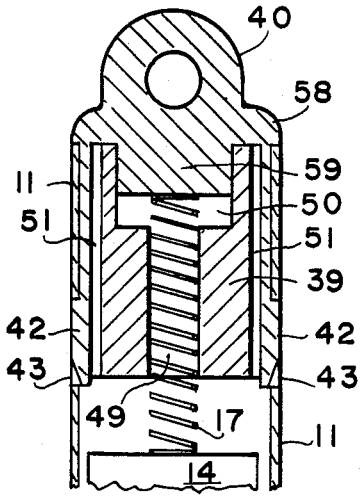
FIG. 6 is a sectional view through the plug assembly taken along line C—C of FIG. 2.
Figure 7:
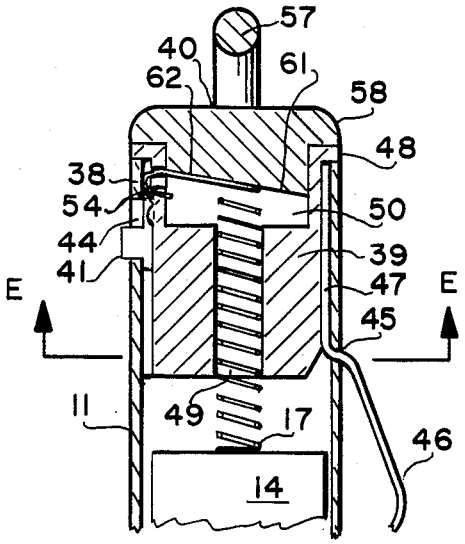
FIG. 7 is a sectional view through the plug assembly taken along line D—D of FIG. 1.

The plug assembly 12, inserted at the back end of the penlight tube 11, FIGS. 6 and 7, further comprises a non-conductive plastic insert 39, a non-conductive lock element with an integral lanyard ring 40, a non-conductive on-off switch button 41, and a conductive battery-to-tube contact spring 17. The plug assembly 12 is locked in place in the tube 11, FIGS. 1 and 6, by a pair of spring activated bosses 42 of the lock element 42. The bosses 42 are diametrically located to intersect and project through first and second apertures 43 which are punched through the wall of the cylindrical tube 11. A third aperture 44, FIG. 7, located in a plane perpendicular to the plane containing first and second apertures 43, gives access to the switch button 41 and provides space for its reciprocating movement from the on-to-off positions.

Also located in the plane perpendicular to the plane containing first and second apertures 43, a fourth aperture 45, being a transverse slit, FIG. 7, allows assembly without rivets or other permanent fasteners of the spring pocket clip 46 to the penlight tube 11. The pocket clip 46 is made of a flat stock of spring steel and is shaped with a multiplicity of bends for insertion through the slit aperture 45 and for clipping over items of clothing. The covered end 47 of the clip 46, on assembly of the plug assembly 12 to the tube 11, is pressed outward radially against the wall of the tube 11 by the insert element 39. The clip 46 is thereby captivated and is securely held in place.

For the plug assembly 12, the insert 39, the lock element 40, and the switch button 41 are made using plastic materials well known in the arts for having both electrical insulating characteristics and resilient spring properties.

The insert 39 has a sectored flange 48, FIG. 7, for providing a positive stop for the plug assembly 12 on its insertion into the penlight tube 11. The outside diameter of the insert 39 is closely fitted to the inside of the tube 11, FIG. 8. An interior passageway 49 and a cavity 50, FIG. 7, are provided about the longitudinal axis of the insert 39 for containing the spiral portion of the battery-to-tube contact spring 17. First and second slots 51, FIG. 6, extend the length of the insert 39 at a displacement of 180 degrees. The depth of the first and second slots 51 permit the spring activated bosses 42 of the lock element 40 to be inserted within the tube 11 until they spring radially outward into first and second apertures 43 of the tube 11, thereby locking the elements together. The bosses 42 may be pushed inward for disassembly of the parts.

Figure 8:
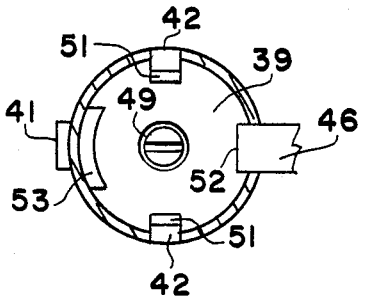
FIG. 8 is a view of the plug assembly taken along the line of E—E of FIG. 7.

A third slot 52 extending longitudinally to the flange 48 provides a space for the covered end 47 of the pocket clip 46. The bottom of the third slot 52, FIG. 8, is flat for full contact with the clip 46. A fourth slot 53 extends from end-to-end of the insert 39 providing space for locating the on-off switch button 41. The third and fourth slots are centered on a plane intersecting the longitudinal axis of the insert 39 and is perpendicular to the longitudinal plane passing through the first and second slots 51. An open-ended slit aperture 54 lies in the longitudinal plane containing the fourth slot 53. This slit aperture 54 extends through the wall of the insert 39 from the inner cavity 50 into the fourth slot 53. The slit aperture 54 allows the battery-to-tube contact spring 17 to extend in an oblique direction from the inner cavity 50 to make contact with the inside wall of the penlight conductive tube 11.

Figure 9:
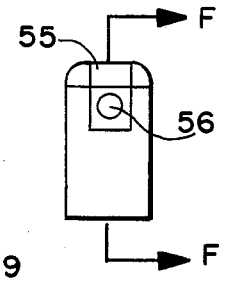
FIG. 9 illustrates the inner surface of a switch button.
Figure 10:
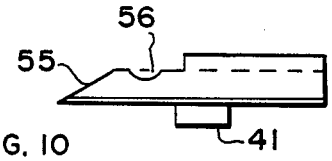
FIG. 10 is an enlarged sectional view of the switch button taken along line F—F of FIG. 9.

The on-off switch button 41 is a single piece component made entirely of plastic material in a complex shape, FIGS. 9 and 10. The major portion of the button 41 is a rectangular sector of a tube upon the convex surface of which is centrally located a raised knob 38 which allows control by thumb or finger contact. At one end of the button 41, FIG. 10, the piece is tapered to provide a wedge or ramp 55, leading from its apex at the convex surface to an inner concave surface at a circular recessed detent 56. Longitudinal movement of the switch button 41 in a direction toward the back end of the penlight tube 11 lifts the contact spring 17 up the ramp 55 to the detent 56 thereby breaking electrical contact with the conductive wall of the tube 11 so as to open the electrical circuit to the lamp 16. A small radial movement of the contact spring 17 on the operation of the switch button 41 is accomodated by the cavity 50 of the insert element 39. In the typical penlight 10 the included angle of the preferred ramp is 32 degrees. The range of operable included angles for the ramp lie between 26 and 40 degrees.

The lock element with lanyard ring 40, of plug assembly 12, is a single piece in a complex geometrical shape of plastic known for its elasticity as well as its electrical insulating properties. As viewed in FIGS. 6 and 7, the lock element 40 has a lanyard ring 57 joined to an end plate section 58 of a diameter equal to that of the penlamp tube 11. The end plate section 58 is in turn joined to a combination comprising a central hub 59, sectors of flange 60 that mesh with the sectored flange 48 of the insert 39, plus two cantilever spring elements with locking bosses 42 that project from opposite ends of a diameter of the end plate section 58 and in a direction away from the plate 58 and parallel to the longitudinal axis of the hub 59. The exposed flat face 61 of the hub 59 is at a preferred angle of ten degrees in an operable range of five to twenty degrees relative to a plane perpendicular to the longitudinal axis and ninety degrees relative to the specific longitudinal plane that intersects the axis of the plenum 10 and the center of the cantilevered spring and boss elements 42.

Figure 11:
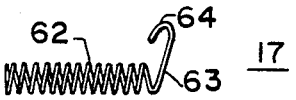
FIG. 11 is a side elevation view of the battery-to-tube contact spring.

The battery-to-tube contact spring 17, FIG. 11, is an elongated spiral 62 having a typical free length of one inch with fifteen coils. A first end of the spring is terminated in a plane perpendicular to the longitudinal axis. The second end of the spring 17 is terminated by a straight wire extension 63 projecting obliquely across the winding of the coiled spring at an angle of seventy two degrees, in a limited operable range of sixty-five to eighty degrees, relative to the axis of the coil 62. The extension 63 further terminates in a contact loop 64 that is folded back in the direction of the first end of the spring 17. The material for making the contact spring 17 must be electrically conductive. In the preferred embodiment the spring 17 is made to the following additional specifications:

- material—music wire, zinc plated, 0.020 inch diameter
- coils—15 per inch in a 1 inch free length
- spring diameter—0.185 inch
- diameter of fold back loop—0.090 inch
- radius (coil axis to a plane parallel to the coil axis and tangent to the fold back loop)—0.200 inch The back end of the penlight 10 is assembled by first inserting the pocket clip 46 and the switch button 41 in the respective apertures 45 and 44 of the tube 11. The plastic insert 39 is then pushed into the tube 11 in such manner as to captivate the clip 46 and the switch button 41 in their respective apertures, 45 and 44. The next step is to insert the contact spring 17, placing the coil thereof 62 within the insert passageway 49 and cavity 50, so that the contact loop 64 extends through the insert open-ended slit aperture 54. Lock element 40, positioned so that the sectored flanges will mesh with those of the insert 39, is pushed in final position so that the contact spring extension 63 will properly seat on the sloping flat face of the hub 59.

In operation, with dry cell batteries 14 in place, the compression of the volute 19 and contact 17 springs produce forces acting in both directions along the longitudinal axis of the penlight 10. Within the end plug assembly 12, the longitudinal force along the axis of the contact spring 17 is resolved into a component oblique force by the combined effects of the angled spring extension 63 and the receding slope 61 of the insert hub 59. The oblique force pushes the spring loop 64 radially outward against the inner wall of the conductive penlight tube 11, making a positive and reliable contact therewith. Therefore an electrical circuit exists, beginning at the batteries 14, through the central terminal 15 and filament of the lamp bulb 16, and returning through the combined lamp base 24 encased within the volute spring 19 through the conductive bulb holder 18 to the cylindrical tube 11, thence through the contact spring 17 to the negative or return terminal of the dry battery power cells 14.

Manual movement of the switch button 41 pushes the contact loop 64 up the button ramp 55 to a position in the button detent 56, thereby breaking the electrical circuit and switching the lamp 16 to the "off" condition.

Figure 12:
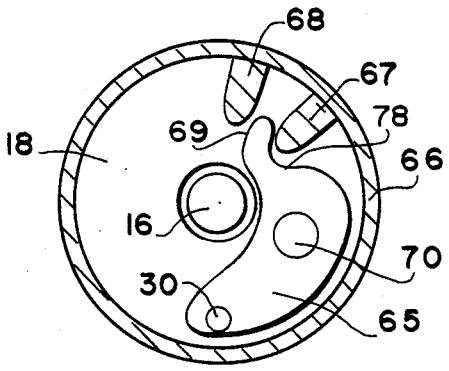
FIG. 12 is a cutaway view of an alternate color filter and cap assembly.

An alternative scheme for color filtering of the penlight illumination is illustrated in FIG. 12 which shows the bulb holder 18, projection lamp bulb 16, an alternate filter element 65, and a cutaway view of an alternate opaque covering cap 66. As shown previously in FIG. 3, the cap has an on axis circular aperture 22 for light emission. Also a filter pivot axle 30 meshes with the circular receptacle 29 of the bulb holder 18. In this alternative scheme the filter element 65 is pivoted in and out of the light transmission path by edge applied forces. On counterclockwise rotation of the covering cap 66 its actuating stub 67 contacts the edge depression and ramp 78 forcing the filter element 65 to pivot into the light transmission path. Clockwise rotation of the cap 66 engages its integral return stub 68 with the leading edge of the filter 69 thereby forcing its withdrawal from the light transmission path. As in the case of the elliptical filter element 20, an indexing detent 70 receives the glass lens of the lamp 16 locking the color filter 65 in place.

Figure 13:
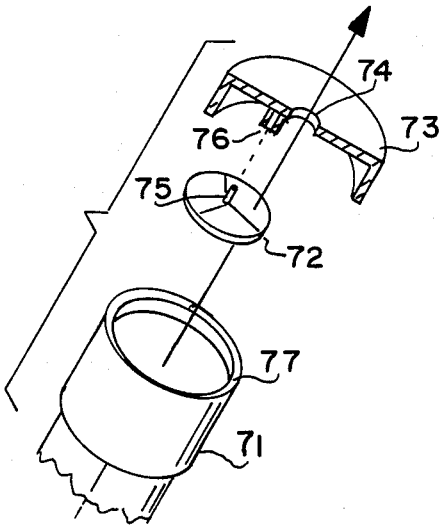
FIG. 13 is an exploded perspective illustration of a sectored disc filter alternative.

A further scheme which provides for two or more colors of penlight illumination is illustrated in FIG. 13. The exploded view shows a modified bulb holder 71, a three color filter wheel or disc 72, and an opaque covering cap 73 with an axis aperture 74 for the emitted light beam. The filter wheel 72 has a central shaft 75 which engages a shaft bearing 76 that is molded into the cap 73 on the inside surface of the end wall at a point adjacent to the edge of the central aperture 74. The outer peripheral edge or circumference of the color disc 72 makes a point contact with a rim 77 that is raised from the peripheral edge of the flat annular surface of the bulb holder 71. Therefore relative rotation of the cap 73 and the bulb holder 71 produces a resulting epicyclic motion of the color wheel 72, bringing the respective color filtering sectors of the wheel sequentially into the light transmission path. The point contact method may use a friction drive, requiring, for example, a rubber surface for either the holder rim 77 or for the edge of the color wheel 72, or for both. Alternatively, the drive means may use an epicyclic gear train which is a well known device in the mechanical arts.

This invention may be embodied in other specific forms without deviating from its concepts or essential characteristics. The embodiment disclosed is therefore to be considered in all respects as illustrative and not limiting, the scope of the invention being indicated by the appended claims.

Having described the invention, I claim:

1. A portable lighting device in the form of a penlight having an elongated open-ended cylindrical tube of electrically conductive material, containing therein at least one dry battery power cell, a plug assembly arranged so as to close a first end of said tube, and a lamp and color filter mechanism arranged so as to close a second end of said tube and to emit light along the longitudinal axis of said penlight, wherein the improvements comprise:

(a) a multiplicity of apertures punched through the wall of said tube in proximity to said first end for the detachable assembly therein of a pocket clip jointly with said plug assembly;

(b) means for producing bidirectional applied forces along said longitudinal axis of said penlight;

(c) means for resolving said longitudinal forces into oblique forces for jointly maintaining low contact resistances yielding reliable continuity of an electrical circuit encompassing a filament of said lamp and filter mechanism;

(d) means, responsive to manual control, for overcoming said oblique forces thereby breaking the continuity of said electrical circuit, causing said lamp filament to cease its emission of light;

(e) means, responsive to a rotational manual control about said longitudinal axis, for emitting a collimated light beam as thereby selected from among a multiplicity of different colors; and (f) a ring, integrated with said plug assembly in a longitudinal plane through said penlight, for attachment of a lanyard.

2. A lighting device according to claim 1, wherein said multiplicity of apertures through the wall of said tube further comprises:

(a) a pair of rectangular apertures, diametrically located, for receiving a pair of spring activated bosses for cooperatively lockng said plug assembly in said tube;

(b) a third aperture, located in a plane perpendicular to the longitudinal plane containing said pair of rectangular apertures, for access to an on-off switch button, said third aperture permitting reciprocating longitudinal movement of said button between on and off positions; and (c) a fourth aperture, in the form of a transverse slit, centered about said perpendicular longitudinal plane, through which an end section of said pocket clip is inserted for the purpose of detachable assembly of said clip to said tube.

3. A lighting device according to claim 1, wherein said means for producing bidirectional mechanical forces comprise:

(a) cooperative interaction between a volute spring surrounding a screw type base of a lamp bulb and compressed between said base and a bulb holder, said holder and said bulb being components of said lamp and color filter mechanism; and (b) a spiral segment of a battery-to-tube contact spring, compressed between a return terminal of said battery power cell, as contained in said tube, and a lock element of said plug assembly under conditions whereby the axis of said spiral segment is arranged coincident with the longitudinal axis of said lighting device.

4. A lighting device according to claim 1, wherein said means for resolving said longitudinal forces into oblique forces comprise:

a straight wire extension of a battery-to-tube contact spring terminating in a contact loop where said extension projects across a diameter of said spiral section at a nominal oblique angle in the operable range of 65 to 80 degrees relative to the axis of said spiral; said extension responsive under application of said longitudinal forces to slide along in contact with a receding slope of a flat hub face of a lock element of said plug assembly to a position of equilibrium, said flat hub face having an angle in an operable range of 70 to 85 degrees in a plane containing said straight wire extension relative to the axis of said spiral.

5. A lighting device according to claim 4, wherein a preferred nominal oblique angle of said wire extension is 72 degrees relative to the axis of said spiral and the preferred angle of said flat hub face is 80 degrees in said plane containing said straight wire extension relative to the axis of said spiral.

6. A lighting device according to claim 1, wherein said means for overcoming said oblique forces, thereby breaking said electrical circuit, comprise:

(a) said conductive cylindrical tube;

(b) said plug assembly, comprising:

a switch button for the application of manual control, said button made of electrical insulating material, said button having a physical configuration comprising a ramp having an included angle in an operable range of 26 to 40 degrees and a detent in proximity to the top of said ramp, a contact spring for producing said mechanical forces, said spring made of electrical conducting material, said spring having a physical configuration comprising a spiral section for contact with said power cell and an obliquely offset straight section terminating in a loop for contact with the inside wall of said cylindrical tube, an insulating insert having a passageway, a cavity, and aperture therein for enclosing said contact spring, and a longitudinal slot in the outer surface for enclosing and guiding reciprocating longitudinal movements of said switch button, and an insulating lock element comprising a central hub having a flat surface for restraining said contact spring; wherein a longitudinal movement of said switch button, in a direction toward said first end of said tube, responsive to manual control, interjects said switch button ramp between said contact loop of said contact spring and said inside wall of said tube, thereby breaking said electrical circuit continuity, said contact spring being responsive to said interjection of said ramp in sliding radially inward upon said flat hub face until said contact loop is positioned in said button detent, said detent for holding said lamp in the off condition.

7. A lighting device according to claim 6, wherein said ramp of said switch button has a preferred included angle of 32.6 degrees.

8. A lighting device according to claim 1, wherein said means for emitting a collimated light beam selected from among a multiplicity of colors with at least one color of the visible spectrum comprise:

(a) a holder, having an axial cavity for containing a lamp bulb with the envelope of said bulb extending outward from an exit aperture in a first end of said holder, said holder having a second end adapted for assembly in said cylindrical tube;

(b) an opaque cap, having an axial aperture in its end wall for the emission of said light, said cap having means for covering said first end of said holder, thereby shielding off-axis emissions of light;

(c) an optical filter, placed between said holder and said opaque cap, responsive to applied illumination in transmitting said colors; and (d) means, responsive to said rotational manual control, for placing said optical filter in said light beam.

9. A lighting device according to claim 8, wherein said means for covering said first end of said holder comprise:

(a) a multiplicity of slots extending longitudinally half the distance from the open brim toward the end of said cap that contains said aperture therein so as to form sectors in the circumferential wall of said cap, said slots permitting expansion of the circumference in proximity to said brim as said cap is forced over said holder; and (b) said sectors of said circumferential wall each having a lip of material extending radially inward from said brim for detachably enclosing a raised flange section of said first end of said holder.

10. A lighting device according to claim 8, wherein said means for placing said optical filter in said light beam comprise:

(a) said optical filter in a substantially elliptical shape, having a principal axis, intersecting at a first end thereof an axis of a pivot axle and at a second end thereof an axis of a traveling pin, said pivot axle perpendicular to and extending from a first side of said filter, said traveling pin perpendicular to and extending from a second side of said filter, said optical filter further having a minor axis, perpendicular to said principal axis, said minor axis intersecting at a first end thereof an aperture extending through the thickness of said filter, said minor axis intersecting at a second end thereof a circular depression in said first side of said filter;

(b) a circular receptacle in proximity to the periphery of an annular flat surface of said first end of said holder for containing said filter pivot axle;

(c) an oval receptacle, arranged with its principal axis coincident with a radius and molded into the inner surface of said end wall of said opaque cap, for containing said traveling pin; and (d) means for axial rotation of said opaque cap about said holder, responsive to applied manual force, said filter responsive in turn to torque at said traveling pin resulting from cap rotation in turning about said pivot axle between a first indexed position, where said lamp bulb envelope is seated in said aperture extending through said filter so as to emit the applied light beam, and a second indexed position, where said lamp bulb envelope is seated in said circular depression located on said filter minor axis so as to emit a colored filtered light beam.

11. A lighting device according to claim 8, wherein said means for placing said optical filter in said light beam comprise:

(a) said optical filter substantially in the form of a sector of an annular flat ring having on a first side thereof a pivot axle and an indexing detent, said pivot axle located in proximity to a first angle subtending said sector, said indexing detent located centrally in said filter along the bisecting angle of said sector, said filter further having an edge depression and ramp and an inner radius at least as large as the radius of said exit aperture of said holder;

(b) a circular receptacle in proximity to the periphery of an annular flat surface of said first end of said holder for containing said filter pivot axle;

(c) a first stub projecting radially inward from said opaque cap for engaging said filter edge depression and ramp;

(d) a second stub projecting radially inward from said opaque cap, separated from said first stub by an angular distance equal to the angular distance from said filter edge depression to a second angle subtending said sector, for engaging said filter; and (e) means for axial rotation of said opaque cap about said holder, responsive to applied manual force, said filter responsive in turn to edge applied force at said first stub due to cap rotation, in turning about said pivot axle between a first indexed position where said lamp bulb envelope is seated in said inner radius of said sector so as to then transmit the applied light beam and a second indexed position where said lamp envelope is seated in said centrally positioned indexing detent so as to then emit a filtered light beam.

12. A lighting device according to claim 8, wherein said means for placing said filter in said light beam comprise:

(a) said optical filter in the form of a circular disc of a diameter at least as large as an outer radius of an annular surface of said first end of said bulb holder, said disc filter comprising a multiplicity of angular sectors, each said sector exhibiting a specific color filtering response, each said sector having on a first side thereof, at a uniform radial distance, a circular indexing detent for engaging said lamp bulb envelope, a first sector having said indexing detent extending through said disc to create a clear aperture, said disc having on a second side thereof a central shaft for rotation thereabout;

(b) a rim on the annular end surface of said bulb holder, in proximity to the outer circumference of said annular surface, for engaging a circumferential edge of said disc filter;

(c) a shaft bearing molded into an inside end wall of said opaque cap adjacent to said axial aperture for containing said filter central shaft;

(d) a drive means between said holder rim and said filter circumferential edge for rotation of said disc about said central shaft; and (e) means for axial rotation of said opaque cap about said holder, responsive to applied manual force, for epicyclic movement of said disc filter to interpose said color sectors, sequentially, between said lamp bulb and said cap aperture, said first sector for emitting a first color of light, a second sector for emitting a beam of light in a second color, and the n th sector for emitting a beam of light in the n th color.

13. A lighting device according to claim 12, wherein said drive means between said holder rim and said filter circumferential edge, comprise a frictional contact between applied rubber surfaces at said bulb holder rim and said circumferential disc filter edge.

14. A lighting device according to claim 12, wherein said drive means between said holder rim and said filter circumferential edge comprise a rim internal spur gear for said bulb holder, and a spur gear enclosing said disc filter.

15. A penlight having an elongated tubular body containing at least one dry battery power cell; an illuminating lamp; an electrical circuit enclosing a switching means, said lamp, and said power cell; said tubular body adapted for closing one end thereof by means of a plug assembly, wherein the improvement comprises:

(a) a slit aperture located inboard and extending transversely in said tubular body in proximity to said end;

(b) a pocket clip, formed to fit through said aperture and extend toward said end along the inside wall of said tubular body and also extend away from said end along the outside of said tubular body; and (c) said plug assembly comprises an insert adapted to fit inside said tubular body end thereby forcing said interior extension of said pocket clip against said inside wall so as to affix said pocket clip to said penlight.

16. A switch for a flashlight having an electrically conductive tubular body, adapted for access to a manual control element, wherein the improvement comprises:

a compressible contact spring extending from a terminal of a power cell to engage a point on the interior wall of said tubular body, said spring having a spiral section for disposal along the longitudinal axis of said flashlight and a projection extending outward from said longitudinal axis to a terminating means for engaging said interior wall;

(b) an assembly of insulating elements within said tubular body providing passageways for containing said spring and a receding surface in contact with said outward projection for resolving axial forces of said spiral spring, under compression, into lateral forces for positive contact between said terminating means and said interior tubular body wall; and (c) a switch button of an insulating material, adapted for reciprocating motion responsive to manual control, in a space between said tubular body wall and a slot in said assembly of insulating elements, said button having a ramp for interjection between said conductive wall and said spring terminating means so as to interrupt current flow in an electrical circuit, said ramp extending to a holding detent for said terminating means to effect a continued circuit off condition.

17. A flashlight having a cylindrical tubular body, at least one dry battery power cell, a lamp bulb, and an electrical circuit for said lamp responsive to manual control, wherein the improvement comprises:

(a) a lamp bulb holder, adapted for closing an end of said tubular body, a cavity in said holder and an annular surface for centering said lamp bulb;

(b) an opaque cap for covering said bulb holder, said annular surface, and said lamp bulb, rotatablely mounted to said bulb holder, said cap containing a central aperture through which said lamp bulb can emit light;

(c) an optical color filter, positioned off center on said annular surface within said opaque cap; and (d) means for turning said filter, relative to said annular surface, over said lamp bulb in response to a rotation of said opaque cap, for emitting colored light beams from said flashlight.

18. A flashlight according to claim 17, wherein said means for turning said filter over said lamp bulb comprise:

(a) a means of pivoting said optical color filter about a location off center of said annular surface; and (b) a pin projecting from a surface of said filter into a receiving oval receptacle located off center from said opaque cap aperture, so that rotation of said cap relative to said annular surface swings said filter between said lamp bulb and said cap aperture for control of said colored light beam emissions.

19. A flashlight according to claim 17, wherein said means for turning said filter over said lamp bulb comprise:

(a) a rim, raised upon said annular surface in proximity to the outer circumferential edge thereof, said rim having a means on its inner circumference for engaging said optical filter;

(b) a disc having a diameter at least as large as a distance extending from said rim inner circumference through the axis of said annular surface to a point beyond said centered lamp bulb, said disc comprising a multiplicity of light transmission filtering sectors, a shaft projecting from one surface of said disc for uniform rotation of said sectors thereabout, said disc having a means on its outer surface for engaging said annular surface rim;

(c) a shaft bearing molded into the inner surface of said opaque cap for the insertion therein of said disc shaft, said shaft bearing positioned on the radius adjacent to the edge of said central aperture for establishing contact between said rim and said disc so that relative angular motion therebetween, responsive to applied manual torqueing forces, turns said filter over said lamp bulb; and (d) means, responsive to applied manual forces, for holding said disc relative to said lamp bulb in each of said multiplicity of filtering sectors.

20. A flashlight according to claim 19, wherein said means for engaging said optical filter and said means for engaging said annular surface rim comprise a frictional epicyclic drive train.

21. A flashlight according to claim 19, wherein said means for engaging said optical filter and said means for engaging said annular surface rim comprise a geared epicyclic drive train.

22. A flashlight, according to claim 17, wherein said means for turning said filter over said lamp bulb comprise:

(a) a means of pivoting said optical color filter about a location off center of said annular surface between a first position and a second position;

(b) an actuating stub, being part of and extending inward from said opaque cap, for contact with a depression and ramp formed in an edge of said filter so that angular rotation of said opaque cap in a first direction relative to said annular surface, responsive to applied torque, pushes said filter over said lamp bulb to said first position;

(c) a return stub, being part of and extending inward from said opaque cap, for contact with a leading edge of said filter so that angular rotation of said opaque cap in a direction in reverse of said first direction, responsive to applied reverse torque, withdraws said filter from over said lamp to said second position; and (d) means, responsive to manual control for holding said filter in said first and said second positions.

23. A flashlight according to claim 17, further comprising a first spring in the form of a volute for support of said lamp bulb in a cavity of said holder and for electrical contact with said tubular body, a second spring acting through at least one dry cell battery for establishing a longitudinal force in the direction of said lamp, said resulting force for seating the envelope of said lamp bulb in a detent of said filter, said force yielding as said filter is turned over said lamp bulb thereby permitting a reciprocating motion of said lamp bulb as said filter is turned about indexed positions that are determined by said seating of said bulb envelope in said filter detent.

24. A switch for a flashlight having an electrically conductive tubular body, as recited in claim 16, wherein said contact spring having a terminating means for engaging said interior wall further comprises a continuation of said projection extending outward from said spiral section in the form of a folded loop lying in a longitudinal plane of said flashlight in a slit aperture in an insulating element through which said loop projects to engage said interior wall of said flashlight body for a contact point interruptable by said switch button.

* * * * *